US007786368B2

(12) United States Patent
Muramatsu

(10) Patent No.: US 7,786,368 B2
(45) Date of Patent: Aug. 31, 2010

(54) ACTUATOR UNIT FOR PERFORMANCE OPERATOR, KEYBOARD MUSICAL INSTRUMENT AND ACTUATOR UNIT ASSEMBLY

(75) Inventor: Shigeru Muramatsu, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 1011 days.

(21) Appl. No.: 11/023,088

(22) Filed: Dec. 22, 2004

(65) Prior Publication Data

US 2005/0139060 A1 Jun. 30, 2005

(30) Foreign Application Priority Data

Dec. 26, 2003 (JP) ..... 2003-434931

(51) Int. Cl.
*G10H 1/18* (2006.01)

(52) U.S. Cl. ..... 84/615; 84/626; 84/633; 84/658

(58) Field of Classification Search ..... 84/615–619, 84/626, 633, 653, 658, 665, 670
See application file for complete search history.

(56) References Cited

U.S. PATENT DOCUMENTS 5,016,513 A 5/1991 Stahnke
5,131,306 A * 7/1992 Yamamoto ..... 84/19
5,451,706 A * 9/1995 Yamamoto et al. ..... 84/34
5,922,983 A * 7/1999 Muramatsu ..... 84/626
6,420,642 B1 7/2002 Muramatsu et al.
7,314,995 B2 * 1/2008 Muramatsu ..... 84/744

FOREIGN PATENT DOCUMENTS

JP 5-281959 10/1993
JP HEI 10-198348 7/1998
JP 2001-034261 2/2001
JP 2001-34261 A 2/2001

* cited by examiner

*Primary Examiner*—David S. Warren
(74) *Attorney, Agent, or Firm*—Harness, Dickey & Pierce, PLC

(57) ABSTRACT

An actuator unit includes: a performance operator drive device including a movable member that mechanically drives the performance operator member; an optical pattern having a pattern to cause an amount of light reflection or light transmission to gradually vary in accordance with movement of the movable member; and an optical sensor that irradiates light toward the optical pattern and receives light reflected from or transmitted through the optical pattern. One of the optical pattern and the optical sensor is provided to move in interlocked relation to the movable member, and the amount of the reflected light or transmitted light, based on the optical pattern, is detected by the optical sensor, so that a moving position of the movable member is detected on the basis of the detected amount of the reflected or transmitted light.

8 Claims, 5 Drawing Sheets

ACTUATOR UNIT FOR PERFORMANCE OPERATOR, KEYBOARD MUSICAL INSTRUMENT AND ACTUATOR UNIT ASSEMBLY

BACKGROUND OF THE INVENTION

The present invention relates to an improved actuator unit suitable for use with a performance operator member, such as a key of a piano, a keyboard musical instrument provided with such an actuator unit, and an actuator unit assembly composed of a plurality of the actuator units.

In the so-called automatic player pianos, keys of a keyboard musical instrument, such as a piano, are automatically operated to execute an unattended musical performance. Such automatic player pianos are arranged to selectively drive a plurality of key drive devices, provided in corresponding relation to the keys, on the basis of automatic performance information to be performed. Japanese Patent Application Laid-open Publication No. HEI-5-28195 discloses an example of a conventionally-known key drive device (i.e., actuator) for an automatic player piano. According to the disclosure in the No. HEI-5-28195 publication, the actuator in the form of an electromagnetic solenoid is disposed beneath a back portion of each key, and unattended (or automatic) key depressing operation is carried out by a movable member of the solenoid pushing up the back portion of the corresponding key.

In addition to driving the keys via such the actuators (electromagnetic solenoids) on the basis of automatic performance information, it has recently become a common practice to impart a desired touch feeling (or touch) to key operation of a human player by variably controlling a force F for driving the actuator (electromagnetic solenoid) (i.e., "force sense control"). Such "sense of force control" is performed, for example, by using a suitable position sensor to detect displacement of the movable member of the solenoid, key itself or the like and then controlling driving of the actuator, on the basis of the detected displacement (position information), to thereby impart a desired sense of force or reactive force to the key. It has been known that the force F for driving the actuator can be obtained by the following equation of motion:

$$F=MX''+PX'+KX \qquad \text{Mathematical Expression (1),}$$

where X represents position information, X' represents velocity information, X" represents acceleration information, M represents mass, P represents an adhesion coefficient, and K a spring coefficient.

Further, in the case where the force sense control is performed using the actuator (electromagnetic solenoid) of the above-mentioned type or the solenoid is merely subjected to feedback control, it has been known to employ a plunger sensor section which includes an optical sensor provided on the underside of the plunger, and where an operating state of the plunger is detected on the basis of reflected light from a surface opposed to the underside of the plunger (for example, Japanese Patent Application Laid-open Publication No. 2001-34261).

With the conventional actuator for automatic player pianos, as represented by the one disclosed in the No. HEI-5-28195 or No. 2001-34261 publication, only the position is detected, for example, by a position sensor without the necessary physical amounts, i.e. position, velocity and acceleration, being detected separately, and then the velocity and acceleration are determined by differentiation of the thus-detected position. In the case where the force sense control is to be performed using the actuator, it has been conventional to generate a detection signal (control signal) for controlling the actuator driving force F, by obtaining the parameters MX", PX' and KX in Mathematical Expression (1) above on the basis of the sensor-detected position information and velocity and acceleration information determined through differentiation of the position information.

However, calculating the velocity and acceleration information through differentiation of the position information as mentioned above would present the inconvenience that the calculated values tend to include error components. Further, if the acceleration information is calculated through differentiation of the position information, there arises a need to perform an extra filtering process in order to remove noise components included in the value obtained through the differentiation operation, which would thus result in significant time delays. Deterioration in signal quality due to the errors in the detection signals and time delays is undesirable in the driving control of the actuator, and particularly the touch impartment control, because it would cause lowering of control accuracy.

If separate sensors are provided, in the above-discussed conventional actuator for automatic player pianos, for detecting different types of physical amounts, detection signals of the different types of physical amounts could have improved quality. However, with the conventionally-known sensor construction, the provision of the separate sensors presents the problem that the actuator unit tends to be considerably complicated in structure and considerably increase in size. For example, according to one example of a feedback sensor for an actuator disclosed in Japanese Patent Application Laid-open Publication No. 2001-34261 which corresponds to U.S. Pat. No. 6,420,642, a current position of the plunger is detected on the basis of variation in the amount of reflected light corresponding to variation in the distance between the solenoid and the sensor; in this case, however, the actuator unit has to have an overall height that is at least equal to a combination of a height corresponding to a stroke amount of the plunger and the height of the sensor itself Further, in the case where a gray scale is detected via a photo-interrupter, as discussed as a related prior technique in the No. 2001-34261 publication, it is difficult to downsize the sensor, because the gray scale projects from a side surface of the plunger and the photo-interrupter is positioned in such a way as to face opposite surfaces of the gray scale.

SUMMARY OF THE INVENTION

In view of the foregoing, it is a first object of the present invention to provide an actuator unit which can obtain high-quality position information with a simple and small-size (compact) structure.

It is a second object of the present invention to provide an actuator unit which can perform feedback control using multi-dimensional, high-quality physical information, such as speed, velocity and acceleration information, of a plunger.

In order to accomplish the above-mentioned objects, the present invention provides an actuator unit for a performance operator member, which comprises: a performance operator drive device including a movable member that mechanically drives the performance operator member; an optical pattern having a pattern to cause an amount of light reflection or light transmission to gradually vary in accordance with movement of the movable member; and an optical sensor that irradiates light toward the optical pattern and receives light reflected from or transmitted through the optical pattern. Also, in the present invention, one of the optical pattern and the optical sensor is provided to move in interlocked relation to the movable member, and the amount of the reflected light or transmitted light, based on the optical pattern, is detected by the optical sensor, so that a moving position of the movable member is detected on the basis of the detected amount of the reflected light or transmitted light.

With the optical pattern arranged to cause an amount of light reflection or light transmission to gradually vary in accordance with movement of the movable member, it is possible to detect a moving position of the movable member with a considerably high accuracy as compared to the conventional techniques. Also, because the optical pattern is planar in shape, the apparatus construction does not particularly increase due to the provision of the optical pattern, and the actuator unit can be significantly reduced in size as a whole.

The actuator unit of the present invention further comprises a velocity detector that detects a moving velocity of the movable member, and the velocity detector is constructed separately from the optical sensor. Further, in the actuator unit of the present invention, the optical pattern is provided on a detected member that is in turn mounted on the movable member, and the optical pattern moves together with the movable member. Furthermore, the optical sensor is fixedly provided in a predetermined position, the velocity detector includes a sensor section fixedly provided in a predetermined position, and the sensor section provides an output corresponding to the moving velocity of the movable member. The optical sensor and the sensor section of the velocity detector are provided as a unit in predetermined positional arrangement.

In the actuator unit of the present invention, which further comprises the velocity detector for detecting the moving velocity of the movable member and the velocity detector is constructed separately from the optical sensor, the position and velocity of the movable member can be individually detected in a direct manner. Because the two items of information, i.e. position and velocity, of the single movable member can be detected simultaneously and at the same place, highly accurate position information and velocity information of the movable member can be obtained with a minimized time delay. Further, by calculating acceleration information of the movable member on the basis of the two items of information, position and velocity information, it is possible to reduce errors and time delay contained in the acceleration information. Thus, with the actuator unit of the present invention reduced in size as noted above, it is possible to acquire position information, velocity information and acceleration information with significantly enhanced quality.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

First, a description will be made about a first embodiment of an actuator unit which comprises a unit of a light-reflection type sensor and a velocity detector constructed separately from the light-reflection type sensor.

Figure 1A:
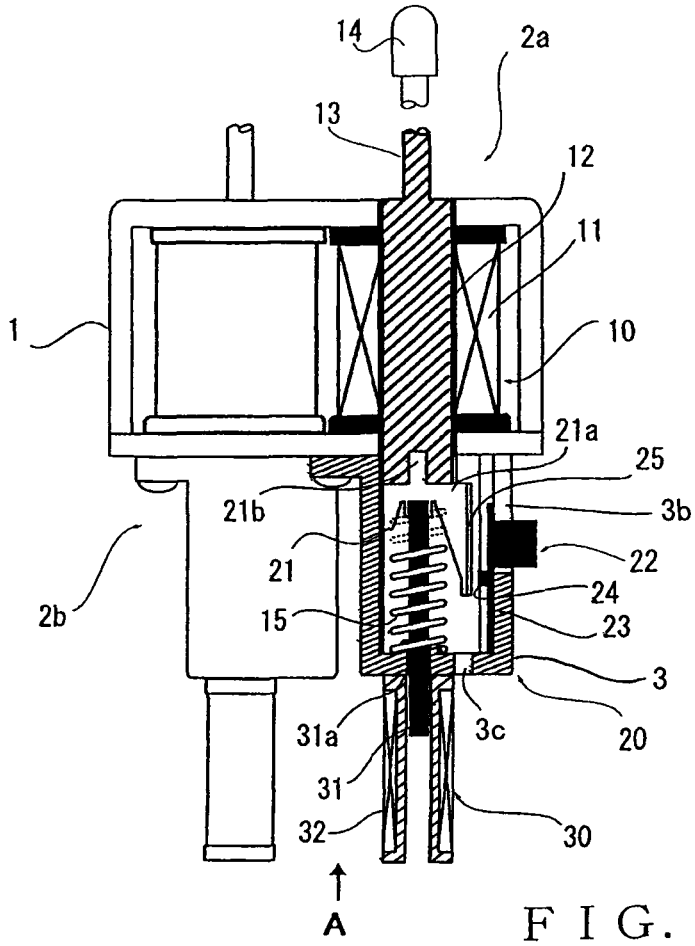
FIG. 1A is a sectional side view of an actuator unit in accordance with a first embodiment of the present invention and FIG. 1B is a bottom end view of the actuator unit taken in a direction of arrow A.
Figure 1B:
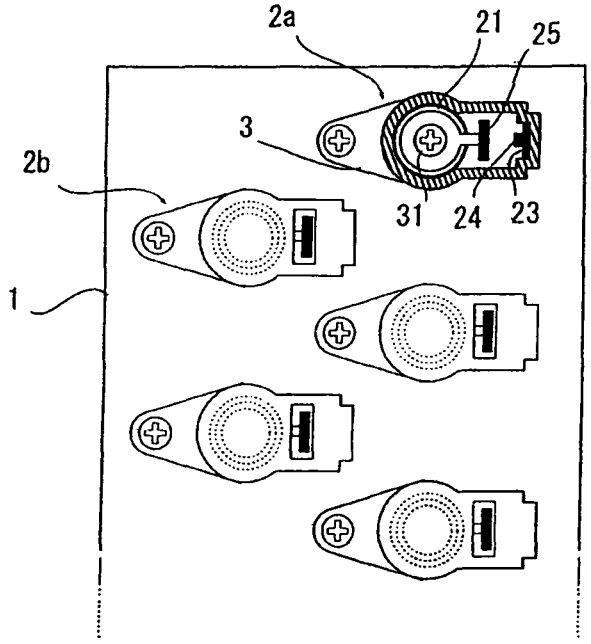

FIG. 1 is explanatory of an example construction of the first embodiment of the actuator unit, of which FIG. 1A is a partly-sectional side view of the actuator unit and FIG. 1B is a bottom end view of the actuator unit taken in a direction of arrow A of FIG. 1A. Specifically, FIG. 1 shows an actuator unit assembly having a plurality of the actuator units 2*a*, 2*b*, . . . held in place by a common (or same) yoke 1. The actuator units 2*a*, 2*b*, . . . provided, for example, in corresponding relation to keys of a keyboard musical instrument (not shown), such as a piano, and these actuator units 2*a*, 2*b*, . . . are used to impart a desired touch (i.e., reactive force/force sense) to key operation by a human player. The actuator units 2*a*, 2*b*, . . . are constructed identically, and in FIG. 1A, there is shown, in a vertical sectional view, a specific construction of only one of the actuator units 2*a*. The following paragraphs representatively describe the actuator unit 2*a*.

The actuator unit 2*a* generally comprises: an actuator section 10 in the form of an electromagnetic solenoid; a position sensor section 20 for detecting an operating position of a movable member of the actuator section 10; and a velocity sensor section 30 for detecting an operating velocity of the movable member of the actuator section 10. The actuator section 10 has an outer periphery surrounded by the yoke 1. Namely, the respective actuator sections 10 of the actuator units 2*a*, 2*b*, . . . are disposed within the yoke 1, so that all of the actuator units 2*a*, 2*b*, . . . are held in place by the same yoke 1. Each of the actuator units 2*a* (2*b*, . . . ) has a casing member 3 screwed to the underside of the yoke 1. Via the casing member 3, the position sensor section 20 and velocity sensor section 30 are coupled to the actuator section 10; namely, the position sensor section 20 and velocity sensor section 30 are accommodated together as a unit (i.e., unitized structure) in the casing member 3, and this unit is attached to the actuator section 10.

The actuator section 10 includes an electromagnetic solenoid coil 11, and a rod-shaped plunger (i.e., the above-mentioned movable member) 12 inserted in an shaft center of the coil 11 in such a manner that the plunger 12 is linearly movable in both directions. The coil 11 is oriented so that its shaft center extends vertically, and the shaft center has upper end lower ends communicating with through-holes formed in upper and lower wall portions of the yoke 11; thus, upper and lower end portions of the plunger 12 are allowed to extend through the through-holes of the yoke 11. The plunger 12 has a shaft 13 extending from the upper end thereof coaxially with the plunger 12. Shaft head 14, which can contact the corresponding key (not shown) of the keyboard musical instrument, is provided at the distal end of the shaft 13.

Detected member 21, which is one of various components of the position sensor section 20, is coupled to the lower end of the plunger 12 coaxially with the plunger 12. As seen in FIG. 1, the detected member 21 has a base portion 21*a*, and an end surface of the base portion 21*a* has substantially the same diameter as an end surface of the plunger 12. The base portion 21*a* has an upward projection 21*b* extending from a substantial central area of the upper end surface thereof. The projection 21*b* of the base portion 21*a* is fitted in a substantial central area of the lower end surface of the plunger 12, so that the detected member 21 is attached to the plunger 12.

Rod-shaped magnet 31, which is one of various components of the velocity sensor section 30, extends downward from a lower end surface portion of the base portion 21*a* of the detected member 21 coaxially with the plunger 12. The casing member 3 has a hole 31 formed in its bottom wall portion so that the magnet 31 extends through the bottom wall portion.

Namely, the detected member 21 which is one of the components of the position sensor section 20 and the magnet 31 which is one of the components of the velocity sensor section 30 are coupled to the plunger 21 in coaxial relation thereto so that the detected member 21 and magnet 31 are arranged as a unit, and this unit comprising the detected member 21 and magnet 31 is movable together with linear displacement of the plunger 12. In other words, the unit is movable in parallel with a side wall of casing member 3.

Further, the plunger 12 is normally urged upward by a spring 15 disposed within the casing member 3, so that, even during a non-activated time (OFF) period of the actuator (i.e., non-energized state of the electromagnetic coil 11), the plunger 12 can be held via the spring 15 at a top dead center as illustrated in FIG. 1A. The spring 15 functions to prevent the plunger 12 from lowering due to the weight of the plunger 12; thus, it is desirable that the spring 15 have a strength only necessary for supporting the weight of the plunger 12 and impart no extra load to the plunger 12. In the illustrated example, the actuator unit 2*a* is constructed as a touch imparting actuator, and this is why the spring 15 is provided to support the actuator unit 2*a* from below. Operation of the actuator unit 2*a* during touch impartment control will be later described. Note that the spring 15 may be omitted depending on the application of the actuator (e.g., in the case where the actuator is constructed to a drive a key).

The position sensor section 20 includes the above-mentioned detected member 21 and a detection section (light-reflection type sensor). The casing member 3 has a side opening 3*b*, and the detection section 22 is disposed in the side opening 3*b*. The detection section 22 includes a sensor chip 24 positioned on a sensor substrate 23, and this sensor chip 24 is, for example, in the form of a small-sized, reflection type optical sensor composed of a light emitting element and light receiving element. Reflecting plate 25, which operates in conjunction with the sensor chip 24, is provided on and along a side surface of the base portion 21*a* opposing the optical sensor 24. The reflecting plate 25 reflects light emitted from the light emitting element of the sensor chip 24, so that the reflected light is received by the light receiving element. Note that the reflecting plate 25 has a vertical (top-to-bottom) length that may be set appropriately corresponding to the overall stroke length of the plunger 12.

Figure 2:
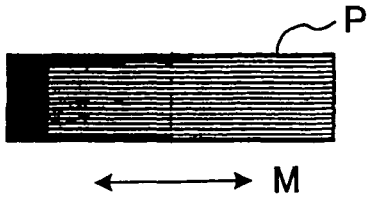
FIG. 2 is a plan view showing an example of an optical density pattern formed on a reflecting plate of a position sensor section employed in the actuator unit of FIG. 1.

In the instant embodiment, the reflecting plate 25 has, on its surface opposed to the sensor chip 24, an optical pattern in the form of a predetermined optical density pattern (gray scale) having white and black portions as illustrated in FIG. 2. Thus, the reflecting plate 25 with the optical pattern is opposed to and placed in parallel with a light emitting/receiving surface of the sensor chip 24, and the reflecting plate 25 with the optical pattern moves in parallel with the light emitting/receiving surface of the sensor chip 24, namely in vertical to a light axis of the sensor chip 24. The optical pattern is formed in such a manner that a ratio of the area of the white portions (or black portions), per predetermined region corresponding to the detection range of the sensor chip 24, on the surface of the reflecting plate 25 gradually increases (or gradually decrease) along a direction of the movement of the plunger 12 as indicated by arrow M. With such a reflecting plate 25 having the optical pattern where the ratio of the area of the white portions (or black portions) on the surface of the reflecting plate 25 gradually increases (or decreases) continuously, the ratio of the area of the white portions (or black portions) of the reflecting plate 25, opposed to the sensor chip 24, gradually increases (or decreases) in response to vertical positional variation (i.e. displacement) of the reflecting plate 25 relative to the sensor chip 24, in response to which a reflection characteristic value of the reflecting plate 25 gradually increases (or decreases). Thus, in response to vertical positional displacement of the reflecting plate 25 relative to the sensor chip 24, an amount of reflected light sensed by the sensor chip 24 gradually increases (or decreases). Therefore, in accordance with the amount of reflected light from the reflecting plate 25, sensed by the sensor chip 24, the position sensor section 20 can provide a detection value corresponding to a relative operating position of the detected member 21 (reflecting plate 25). Because the detected member 21 vertically reciprocates, relative to the sensor chip 24, together with the reciprocating movement of the plunger 12, the position sensor section 20 can detect an operating position of the plunger 12 of the actuator section 10.

The detection of the operating position of the plunger 12 by the position sensor section 20 can reliably assume desired light reflection characteristics (sensor output characteristics) in accordance with the optical density pattern of the reflecting plate 25, and the position sensor section 20 can detect the plunger position substantially directly (due to the parallel arrangement of the position sensor and the reflecting plate 25); thus, the position sensor section 20 can provide accurate position information that contains no mechanical flexure, distortion, rattle, etc. in a movement path of the plunger 12, as compared to the case where the plunger movement is detected in an indirect manner. Further, with the optical density pattern of the reflecting plate 25 illustratively described above, where the density of the white portions (or black portions) gradually increases (or gradually decreases) continuously and linearly along the moving direction of the detected member 21, the output values of the position sensor section 20 can present linear characteristics and can be effectively prevented from assuming ripples (i.e., wobbles in output voltage). The "linear" characteristics of the output values of the position sensor section 20 mean that the reflected light amount corresponding to the displacement of the detected member 21 (input value) and the detection value of the position sensor section 20 (output value) are proportional to each other. With such arrangements, the position sensor section 20 can provide high-quality position information although the section 20 can be small in size, simplified in construction and mass-produced, and thus, the position sensor section 20 can be suitably used in the actuator unit of the present invention.

Note that the optical pattern construction of the reflected plate 25 is not necessarily limited to the above-described and the optical pattern may be constructed in any other suitable manner to provide desired reflection characteristics; for example, the white/black density ratio may be distributed by the "error diffusion method" so as to provide desired reflection characteristics. Further, instead of the optical density pattern being formed on the reflecting plate 25, the optical density pattern may be formed directly on a side surface of the moving member (i.e., detected member 21). The position sensor section 20 may be in the form of any other suitably-constructed conventional sensor than the light-reflection type sensor as described above, as long as the position sensor and the velocity sensor are constructed as a unit.

The casing member 3 has an opening formed in its bottom wall portion to allow a lower end portion of the reflecting plate 25 to extend out of the casing member 3 when the plunger 12 is located at a bottom dead center.

In the illustrated example, the velocity sensor section 30 is of a moving-magnet type which includes a magnet 31 and a coil 32. The magnet 31 as a whole has an elongated cylindrical shape and is coupled at its top to the plunger 12 via the detected member 21 as noted above. The magnet 31 is oriented vertically to extend along the vertical moving direction of the plunger 12, and it has a lower end portion inserted in the shaft center of the coil 32. The coil 32 has its shaft center oriented in the linear moving direction of the plunger 12 and is disposed around a peripheral surface of a lower end portion of the casing member 3. The coil 32 has an upper end opening, and this upper end opening (i.e., opening in the shaft center) communicates with the above-mentioned hole 31*a* to permit insertion therein of the magnet 31. As the plunger 12 linearly moves, the magnet 31 moves, relative to the coil 32, into and away from the coil 32 together with the plunger 12.

Further, as the plunger 12 moves in the vertical direction (upward while the actuator is driven), the magnet 31 of the velocity sensor section 30 moves in the vertical direction (upward while the actuator is driven) relative to the coil 32 together with the plunger 12; namely, an amount of entry, into the coil 32, of the magnet 31 varies in response to the vertical displacement of the plunger 12. During that time, an inductive voltage is produced in the coil 32 through action of the magnet 31 (variation in the amount of entry, into the coil 32, of the magnet 31). On the basis of variation in the thus-produced inductive voltage, the velocity sensor section 30 can detect an operating velocity of the magnet 31 and hence the plunger 12.

Note that the velocity sensor section 30 may be implemented by any other suitable velocity sensor than the above-described moving-magnet type sensor.

FIG. 1B is a bottom end view of the yoke 1. As shown, the actuator units 2*a*, 2*b*, . . . are arranged discretely in two rows with adjoining ones of the actuator units staggered with each other. Such staggered arrangement is permitted because each of the components of the actuator units 2*a*, 2*b* . . . can be of a small size and simple structure. With the staggered arrangement, intervals between the actuator units 2*a*, 2*b* . . . can be made sufficiently great, so that malfunction due to magnetic interference can be effectively avoided.

Now, a brief description is given about an example manner in which the actuator unit 2*a* is driven. In the illustrated example, the actuator unit 2*a* is used to impart a touch to the corresponding key, and it is assumed here that the actuator unit 2*a* is positioned in such a manner that the shaft head 14 at the distal end of the plunger 12 abuts against a substantial central region of the underside of the corresponding key. As noted earlier, the plunger 12 of the actuator unit 2*a* is normally (even during the OFF state of the actuator unit) inserted through the coil 11, as illustrated in FIG. 1A. Under such conditions, the distal end of the shaft head 14 is kept in abutment with the corresponding key at a rest position. As the human player depresses the key, the plunger 12 is displaced downward. Once a driving signal (i.e., current) is supplied to the actuator section 10 from a driver (not shown) to energize the coil 11, a force attracting the plunger 12 is produced in the coil 11 so as to cause the plunger 12 to keep staying within the coil 11. As a consequence, a reactive force can be imparted, as a touch feeling, to the depression, by the human player, of the key. Thus, by varying the driving signal to be applied to the actuator section 10, the force attracting the plunger 12 can be appropriately controlled so as to impart a desired touch to the depression operation, by the human player, of the key.

In order to achieve the above-described touch impartment control based on the operation of the actuator with a high reliability and accuracy, the quality of the feedback signals (detection signals) provided by sensing the movement of the plunger 12 becomes a very important factor. Because, in the instant embodiment, the position and velocity of the plunger 12 can each be actually measured individually via the separate position sensor position 20 and velocity sensor position 30 in a direct manner, more accurate feedback control can be achieved by using the two actual measurements as the feedback signals, so that the performance of the touch impartment control can be effectively enhanced. For example, in the case where the desired force F is used for the touch impartment control, the force F can be obtained by the following equation of motion, as stated earlier:

$$F=MX''+PX'+KX \qquad \text{Mathematical Expression (1).}$$

where X represents position information, X' represents velocity information, X" represents acceleration information, M represents mass, P represents an adhesion coefficient, and K a spring coefficient. Because, in the instant embodiment, the position information X and velocity information X' of the plunger 12 is actually measured via the separate position sensor position 20 and velocity sensor position 30, respectively, the spring coefficient KX and adhesion coefficient P can be defined on the basis of the actual measurements of the position sensor position 20 and velocity sensor position 30. Further, by calculating the acceleration information on the basis of the velocity information actually measured by the velocity sensor position 30, signal errors and time delay contained in the acceleration information can be minimized, and the mass coefficient M can be defined on the basis of the acceleration information X" having a relatively high accuracy. Namely, according to the instant embodiment, high-quality signals can be obtained for the position, velocity and acceleration, as physical amounts representative of the movement of the plunger 12. As a result, the instant embodiment can achieve touch impartment control of an improved performance.

Figure 3A:
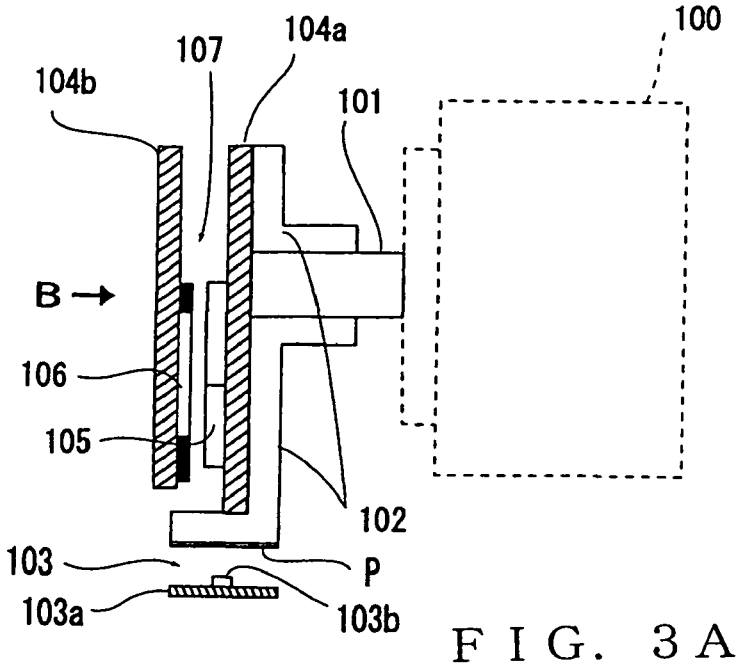
FIG. 3A is a sectional side view of a rotary actuator unit in accordance with a second embodiment of the present invention.

The embodiment has so far been described above in relation to the case in which the actuator section 10 is of the type where the plunger 12 moves linearly. FIG. 3A is a view showing another structural example (i.e., second embodiment) of the actuator unit of the present invention where the sensors are constructed as a unit; more specifically, FIG. 3A is a sectional view explanatory of the actuator unit where a position sensor and velocity sensor are provided as a unit on an actuator that is driven to rotate (rotary actuator).

Rotary motor (i.e., rotary actuator) 100 causes a rotation base 102, coupled via a rotation shaft 101 to the motor 100, to rotate (swing) in two directions within a predetermined rotational angular range. The rotation base 102 has an optical density pattern (gray scale) P on its outer peripheral portion. The optical density pattern P is similar to that shown in FIG. 2 and provided to cover the predetermined rotational angular range within which the rotation base 102 is rotated by the motor (i.e., actuator) 100. Position sensor section 103, which includes a sensor substrate 103*a* and sensor chip 103*b*, is positioned in opposed relation to the outer periphery of the rotation base 102. Surface portion of the outer periphery of the rotation base 102, opposed to the sensor chip 103*b*, is displaced in accordance with variation in the rotational angle of the rotation base 102. Thus, the position sensor section 103 can output position information corresponding to the rotational angle of the rotation base 102.

Namely, the optical density pattern which is integrally or directly formed on and along the outer peripheral surface of the movable member (rotation base) 102 and changes its sensor-detectable density as the movable member 102 angularly moves, and the light-reflection type sensor which detects the angular movement of the movable member 102 in accordance with variation in the amount of reflected light corresponding to the variation in the density of the optical density pattern, can also be applied as a sensor for detecting a rotational position.

Further, the actuator unit of FIG. 3A includes, as the velocity sensor, a moving-magnet type velocity sensor section 107, which in turn includes a magnet 105 and a flat coil 106. The magnet 105, which is retained by a yoke 104*a*, is disposed on a surface of the rotation base 102.

Figure 3B:
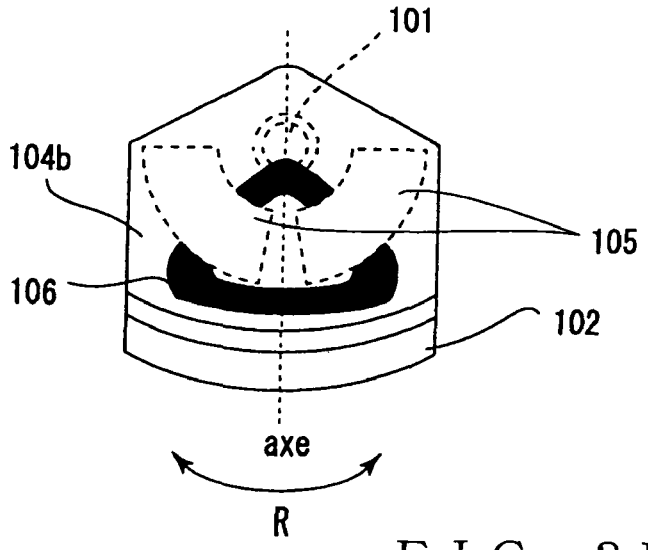
FIG. 3B is a schematic side view of the actuator unit taken in a direction of arrow B, which particularly shows positional relationship between a coil and a magnet of a velocity sensor section employed in the actuator unit.

FIG. 3B is a schematic side view taken in a direction of arrow B, where, for purposes of illustration and explanation, the magnet 105 is depicted by imaginary lines and the illustration of another yoke 104*b* is omitted. As shown, the magnet 105 includes two coils 105 each positioned to cover an angular range of about 45 degrees about the rotation shaft 101, and these two coils 105 are disposed in symmetric relation to each other about an axial line axe of the rotation shaft 101. Double-headed arrow R represents the rotating (swinging) direction of the rotation base 102. The yoke 104*b*, which is disposed in opposed relation to the yoke 104*a*, is fixedly supported by a certain member (not shown), and the flat coil 106 is disposed on the yoke 104*b*. The flat coil 106 is positioned to face the magnet 105 when the rotation motor 100 is in a non-driving position of FIG. 3. As the rotation base 102 rotates via the rotation shaft 101, the magnet 105 held by the yoke 104*a* is angularly displaced relative to the flat coil 106 opposed to the magnet 105, in response to which a distance, to the flat coil 106, of the magnet 105 varies. Thus, the inductive voltage produced in the flat coil 106 varies in response to the variation in the distance, to the flat coil 106, of the magnet 105, so that the velocity sensor section 107 can output velocity information corresponding to the rotating velocity of the rotation base 102.

With the instant embodiment of the rotary actuator too, the actuator, position sensor and velocity sensor can be constructed as a unit of a simple construction and small size, by applying the light-reflection type sensor as the rotational position sensor as described above.

The rotary actuator unit of the type illustratively shown in FIGS. 3A and 3B can be suitably applied to a multiaxially-operable operator member (multidimensional input control device), such as a joystick. The rotary actuator unit illustrated in FIGS. 3A and 3B are particularly suited for use in the three-dimensional input device disclosed in Japanese Patent Application No. 2003-099613 previously filed by the same assignee of the present application. In the three-dimensional input device disclosed in the above-mentioned prior patent application, an operator member, having a generally elongated rod shape, is displaceable along three axes, X, Y and Z axes. X-, Y- and Z-axis sensors are provided for detecting displacement or movement of the operator member along the corresponding axes, and X-, Y- and Z-axis actuators (rotary motors) are provided for imparting a sense of force (reactive force) to the operator member for each of the three axes. The rotation-type actuator unit arranged in the manner of FIGS. 3A and 3B can be used as the sensor/actuator of each of the axes in the disclosed three-dimensional input device. More specifically, the position sensor section 103 and velocity sensor section 107 detect movement, corresponding to operation by the human operator, as rotational movement of the rotation base 102. Rotational driving force of the rotary motor 100 is transmitted via the rotation base 102 to the operator member. By the provision of the position sensor section 103 and velocity sensor section 107, it is possible to obtain high-quality position and velocity detection signals (operated amount information of the operator member). Thus, the driving of the rotary motor 100 can be feedback-controlled with a further improved accuracy on the basis of such detection signals. Therefore, with the three-dimensional input device, employing the inventive rotary actuator unit, it is possible to perform, with an even further enhanced accuracy and precision, servo control based on model operation information (e.g., reference position information) and actual operation by the human operator as well as the touch impartment control on the operator member.

Figure 4:
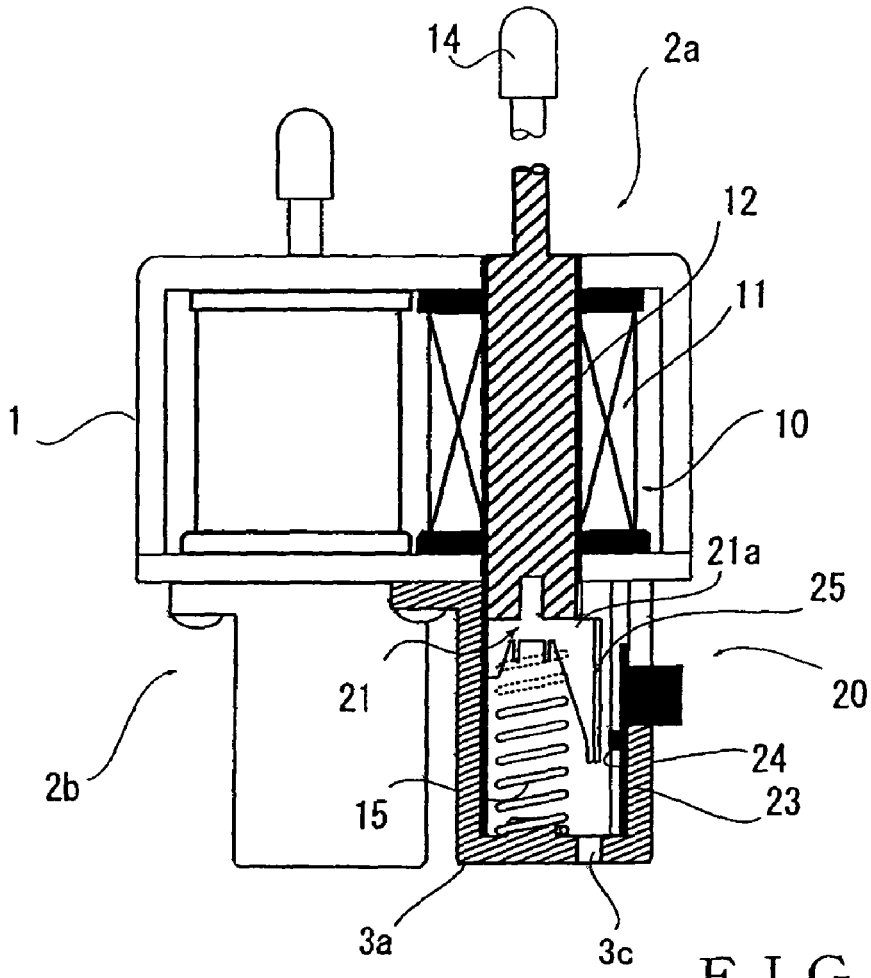
FIG. 4 is a sectional side view explanatory of a structural example of an actuator unit in accordance with a third embodiment of the present invention.

The first embodiment of FIG. 1 has been described above in relation to the case where the actuator section 10, position sensor section 20 and velocity section 30 are constructed as an actuator unit. FIG. 4 illustratively shows a third embodiment of the actuator unit which comprises the actuator section 10 and position sensor section 20 (light-reflection type sensor) with the velocity sensor section of FIG. 1 omitted therefrom. Here, the same elements as those already described in relation to FIG. 1 are indicated by the same reference numerals and will not be described, as appropriate, to avoid unnecessary duplication. In FIG. 4 too, there is shown an actuator unit assembly having a plurality of actuator units 2*a*, 2*b*, . . . held in place by a common (or same) yoke 1. The actuator units 2*a*, 2*b*, . . . are arranged discretely in two rows with adjoining ones of the actuator units staggered with each other.

As in the first embodiment of FIG. 1, each of the actuator units 2*a* (2*b*, . . . ) in the third embodiment includes, as the position sensor section 20, a detected member 21 coupled to the lower end of a plunger 12 coaxially with the plunger 12, a reflecting plate 25 provided integrally on and along a side surface of a base portion 21*a* of the detected member 21, and a sensor chip 24 provided on a surface of a casing member 3*a*, having the detected member 21 accommodated therein, that is opposed to the reflecting plate 25. The reflecting plate 25 has, on its surface opposing the sensor chip 24, a predetermined optical density pattern (gray scale) similar to the one illustrated in FIG. 2 and described above in relation to the first embodiment. The sensor chip 24 irradiates light toward the reflecting plate 25, provided on the side surface of the detected member 21, and receives resultant reflected light from the reflecting plate 25, to thereby output position information of the plunger 12 corresponding to an amount of the received light. As well known in the art, performing a differential operation on the position information of the plunger 12 can provide velocity information and acceleration information of the plunger 12. The casing member 3*a* has an opening 3*c* formed in its bottom wall portion to allow a lower end portion of the reflecting plate 25 to extend out of the casing member 3*a* when the plunger 12 is displaced downward; thus, the vertical dimension of the casing member 3*a* (i.e., dimension in the moving direction of the plunger 12) can be minimized. Whether or not a spring 15 should be provided on the underside of the detected member 21 depends on the application of the actuator unit. In the case where the actuator unit is used for key touch impartment control of a keyboard musical instrument, the plunger 12 is retained at its top dead center via the spring 15.

With the arrangements of the position sensor section 20, where the light-reflection type sensor (i.e., sensor chip 24) and the optical density pattern (gray scale) of the reflecting plate 25 are positioned along the operating direction of the plunger 12, the light-reflection type sensor can be installed efficiently using a limited installing space, with the result that the actuator unit as a whole can be reduced in size as compared to the conventionally-known sensor disclosed in the No. 2001-34261 publication and the traditional sensor using a photo-interrupter. Note that, in order to prevent increase of noise components in the detection signals due to mechanical "rattle", shaky movement, etc. of the movable members (plunger 12 and detected member 21), the distance between the sensor chip 24 and the surface of the reflecting plate 25 where the optical density pattern is provide may be set at an appropriate value. If the sensor chip 24 and the surface of the reflecting plate 25 are too close to each other, the portion of the reflecting plate 25 opposed to the chip 24 will have a smaller light-irradiated area, so that the mechanical "rattle", shaky movement, etc. of the movable members tend to produce greater influences even when the mechanical "rattle", shaky movement, etc. are nominal. In view of this, the distance between the sensor chip 24 and the reflecting plate 25 in the instant embodiment is set so that an amount of variation in the output values of the light-reflection type sensor (i.e., sensor chip 24) relative to variation in the distance of the sensor chip 24 to the reflecting plate 25 can be minimized. Further, because the position sensor section 20 is covered in its entirety with the casing member 3*a* so as to prevent external light from affecting the sensor section 20 and thereby minimize noise components, the sensor section 20 can produce greater output values. Namely, the detection signals can have a sufficiently high S/N ratio, to thereby permit even more accurate detection. It should be understood that similar advantageous results can be attained by the actuator unit of FIG. 1.

Figure 5A:
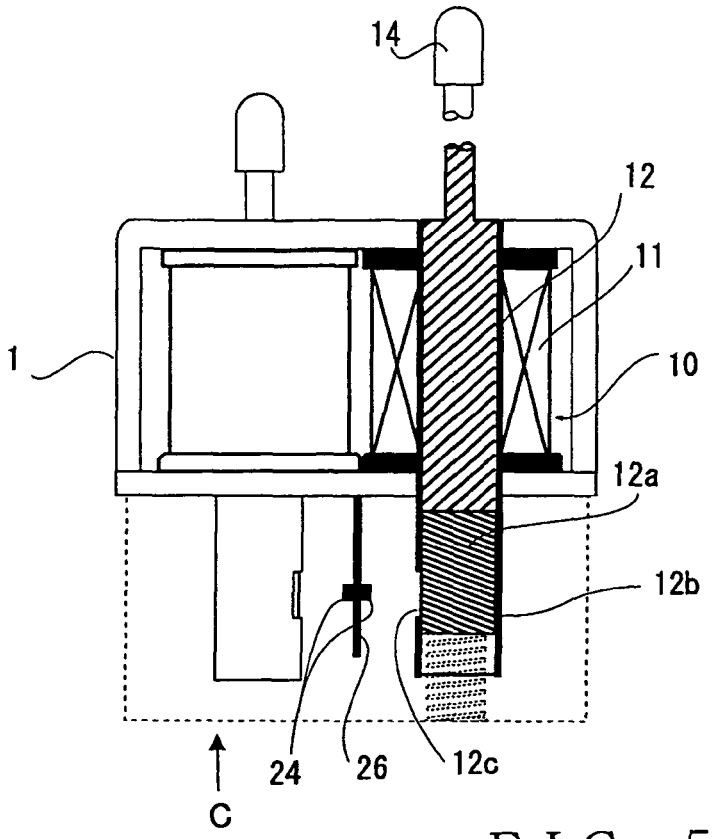
FIG. 5A is a sectional side view explanatory of another structural example of the third embodiment of the actuator unit.
Figure 5B:
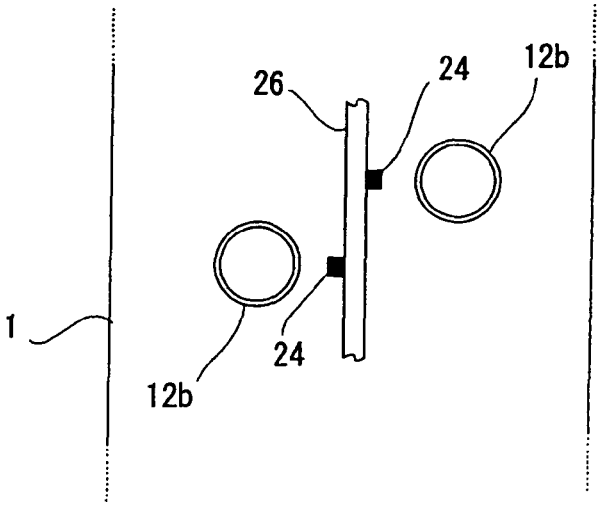
FIG. 5B is a bottom end view of the actuator unit taken in a direction of arrow C of FIG. 5A.

FIG. 5A is a view showing another structural example of the third embodiment of the actuator unit provided with the light-reflection type sensor, and FIG. 5B is a schematic plan view taken in a direction of arrow C of FIG. 5A. In this example, a predetermined optical density pattern (gray scale), similar to the one shown in FIG. 2, is formed directly on a substantially entire peripheral surface of a bar 12*a* extending coaxially with and from the lower end of the plunger 12. The bar 12*a* is a cylindrical member formed of resin, such as PBT (Polybutylene Terephthalate resin) and having generally the same diameter as the plunger 12. Bobbin 12*b*, surrounding the plunger 12 and bar 12*a*, has an open window 12*c* in a predetermined position thereof that should oppose the sensor chip 24, and the sensor chip 24 is disposed on a surface of the sensor substrate 26 opposing the open window 12*c*. Because the optical density pattern is formed on the entire outer peripheral surface of the bar 12*a*, the pattern will never divert from, i.e. fail to be sensed, by the sensor chip 24 even when the plunger 12 has turned about its axis. Further, an entire lower portion of the actuator unit assembly is covered with an external cover as indicated by an imaginary line, so that external or ambient light can be interrupted and prevented from affecting the sensor. Spring for supporting the plunger 12 may be interposed between the lower end of the bar 12*a* of the plunger 12 and the external cover.

The sensor substrate 26 is described below. In the actuator unit assembly, as illustrated in FIG. 5B, the actuator units 2*a*, 2*b*, . . . are arranged in two rows with adjoining ones of the actuator units staggered with each other. The sensor substrate 26 is disposed between the two actuator unit rows, and extends downward from the underside of the yoke 1 with its opposite plate surfaces facing the actuator unit rows. The sensor substrate 26 has is longitudinal dimension (length) corresponding to the length of the rows of the actuator units arranged in the above manner. The single sensor substrate 26 holds a plurality of the sensor chips 24 of all the actuator units. Namely, in the actuator unit assembly of the invention, the plurality of actuator units are arranged, in staggered spaced-apart relation to one another with respect to the sensor substrate 26, in such a manner that the respective sensor chips 24 of the actuator units are disposed adjacent the opposite surfaces of the single sensor substrate 26.

In the illustrated example, the bobbin 12*b* has the open window 12*c* to allow the optical density pattern and sensor chip 24 to oppose each other, as noted above. In an alternative, an entire lower portion of the bobbin 12*b* may be cut off so that the bar 12 having the optical density pattern formed thereon is exposed.

The actuator unit constructed in the manner illustrated in FIG. 5 can accomplish, in addition to the above-discussed various benefits attained by the actuator unit of FIG. 4, even more reliably position detection with a simpler construction, because the optical density pattern is formed directly on the entire peripheral surface of the bar 12*a* extending from the lower end of the plunger 12. Furthermore, because the position sensor section 20 is separated from the solenoid coil 11 and yoke 1, heat transfer from the solenoid coil 11 and yoke 1 to the sensor section 20 can be reduced, so that output drift of the sensor that would be caused by the heat can be minimized. Furthermore, because the sensor can be simplified in structure, the actuator unit can be manufactured at extremely low cost.

Figure 6:
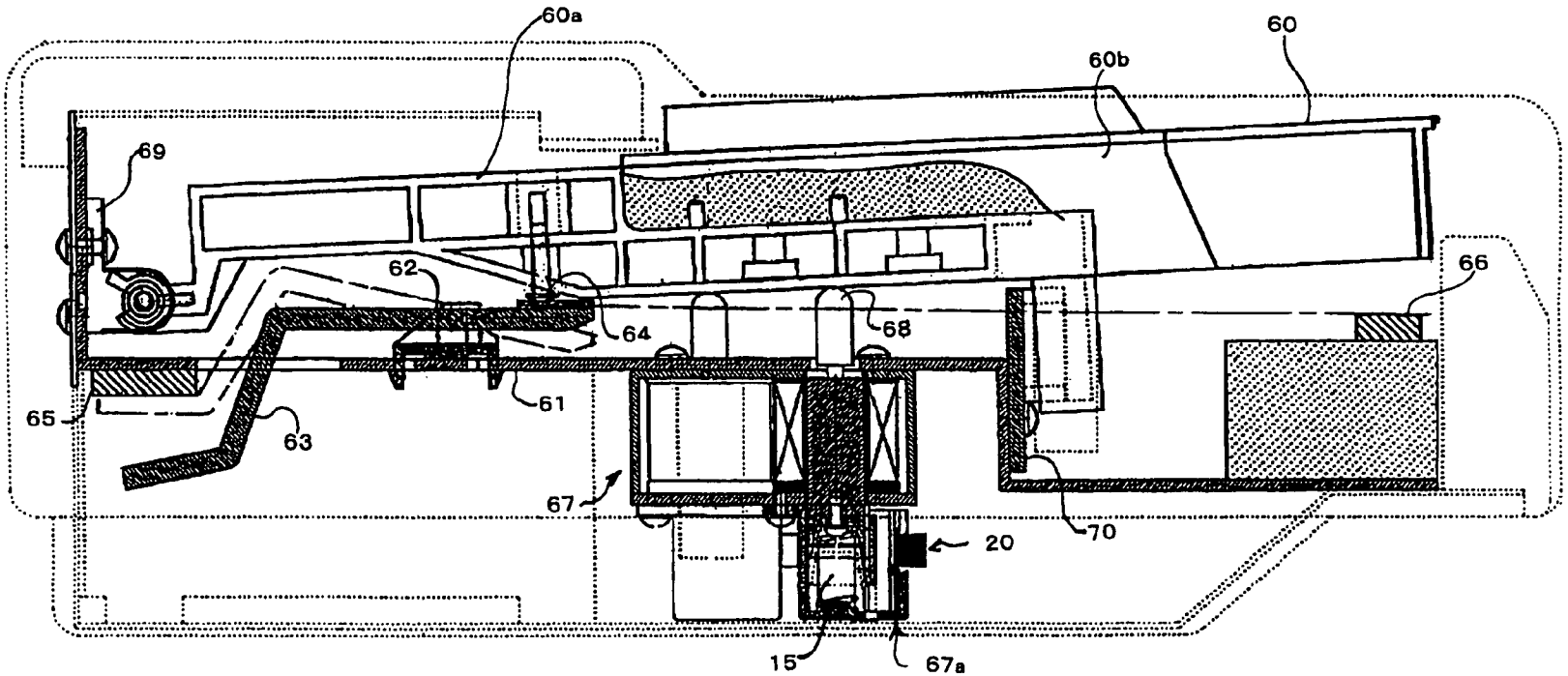
FIG. 6 is a sectional side view of an electronic keyboard musical instrument employing an actuator unit assembly of the type shown in FIG. 4.

FIG. 6 is a sectional side view of an electronic keyboard musical instrument employing the actuator unit assembly of the type shown in FIG. 4, which extractively shows a key action mechanism of the musical instrument. In the figure, reference numeral 60 represents the key that comprises a base section 60*a* and a main key section (e.g., wooden key section) 60*b*. The key 60 is fitted in a rotation support section 69 provided on a frame 61 and supported by a stroke guide 70 for vertical pivotal movement therealong. Hammer 63 is pivotably mounted on the frame 61 via a pivot point 62. Position-adjustable working point 64, provided on the underside of the key 60, abuts against one end of the hammer 63. As the hammer 63 is pressed downward at the one end by the working point 64 in response to depression operation of the key 60, the hammer 63 is caused to pivot (make a pivotal stroke) about the pivot point 62. The other end of the hammer 63 abuts against an upper-limit stopper 65 at a stroke end position of the hammer 63. Further, at a depression stroke end position, the key 60 abuts against a lower-limit stopper 66. In the figure, one-dot-and-dash lines indicate the key 60 and hammer 63 in their respective end positions.

The key action mechanism of FIG. 6 is so simple in structure that almost no reactive force can be imparted from the key 60 when the human player depresses the key 60. Therefore, the above-described actuator unit of the present invention may be employed to impart a reactive force to the key depression. Namely, the actuator unit assembly 67 of the invention is secured to the frame 61 underneath a plurality of the keys 60, and a plurality of actuator units 67*a* are disposed in corresponding relation to the keys 60 of the keyboard musical instrument. Each of the actuator units 67*a* is located neat a substantial middle portion of the corresponding key 60 slightly closer to the distal end of the key 60 than the pivot point 62, and the distal end of the shaft head 68 coupled to the plunger is abutted against the underside of the key 60. In the illustrated example, the key 60 is at its rest position, and the plunger of the actuator unit 67*a* is held at its top dead center by the urging force of the spring 15; namely, the spring 15 is used also as a biasing spring for holding the key 60 at the rest position. As the key 60 is depressed by the human player, the plunger of the actuator unit 67*a* is displaced downward, at which time the actuator unit 67*a* is driven to force the plunger upwardly to thereby impart a reactive force to the key 60. The driving of the actuator unit 67*a* can be feedback-controlled on the basis of the detection signals from the position sensor section 20.

Namely, the actuator unit assembly 67 includes, as a plunger position sensor, the optical density pattern that is formed integrally on and along the side surface of the plunger and varies in the density along the moving direction of the plunger, and a light-reflection type sensor that is positioned in opposed relation to the optical density pattern and detects a position of the plunger. Therefore, although the actuator unit assembly 67 is of an extremely simple structure and small size, it can perform highly accurate reactive force control on the keys 60. The actuator unit assembly 67 of the present invention is suited for use in an electronic keyboard musical instrument that, as a whole, has a small box-shaped structure and has a simple key action mechanism. Whereas the actuator unit assembly of FIG. 6 has been described as used for touch impartment control, the actuator unit assembly of the invention may of course be used for servo control of an automatic player piano.

It should be understood that the keyboard musical instrument, to which the actuator unit assembly of the present invention is applied, may be other than the electronic keyboard musical of the type illustrated in FIG. 6, such as acoustic pianos and organs. The acoustic pianos may be either grand pianos or upright pianos.

Further, although FIG. 6 shows the example where the actuator unit assembly, having the plurality of actuator units held together by the yoke, is employed in an electronic keyboard musical instrument, the present invention is not so limited. For example, a separate actuator unit may be provided for each of a plurality of keys. For example, as a modification of the actuator unit assembly of the type illustrated in FIG. 5, the actuator units may be mounted on an instrument frame discretely in rows staggered along the direction where the keys are arranged side by side, and the sensor substrate (see FIG. 5B) having the sensor chips of the individual actuator units held thereon may be disposed between the rows of the actuator units. Namely, the actuator units themselves need not be assembled in advance when they are to be mounted on the keyboard musical instrument.

Furthermore, although each of the first to third embodiments of the present invention has been described above in relation to the case where the actuator unit (i.e., actuator unit assembly) of the present invention is applied as a driving device for imparting a sense of force to the corresponding performance operator member, the present invention is not so limited, and the actuator unit (actuator unit assembly) of the present invention may be applied as a device capable of performing feedback control on the corresponding performance operator member. Furthermore, whereas each of the first to third embodiments of the present invention has been described above in relation to the case where the actuator unit (i.e., actuator unit assembly) of the present invention is applied to an performance input operator, such as a key of a keyboard musical instrument, the actuator unit of the present invention may be used for more general purposes, for example, as an actuator unit having a sensor for feedback-controlling driving of a plunger (moving member) in apparatus other than keyboard musical instruments.

The optical pattern employed in the present invention is not limited to the density pattern, as illustrated in FIG. 2, where the ratio between the light and dark portions in the light/dark repetition pattern gradually varies, and it may be constructed in any other desired pattern as long as it is a pattern to allow an amount of light reflection or light transmission to vary along the moving direction of the plunger 12 (movable member). For example, the optical pattern employed in the present invention may be a pattern where densities of dot-shaped dark portions and light portions gradually vary along the moving direction of the plunger 12 (movable member), or a ratio between the areas of the dark and light portions gradually varies along the moving direction of the plunger 12 (movable member) (such as a triangular-shape pattern).

Further, the optical pattern employed in the present invention is not limited to the light-reflection type, and it may be of a light-transmission type. In such a case, arrangements are made such that a light transmission pattern is positioned between the light emitting element and light receiving element of an optical sensor.

Furthermore, each of the embodiments has been described as constructed in such a manner that the density pattern, i.e. optical pattern, is movable in interlocked relation to the plunger 12 (movable member) while the optical sensor is fixed in position. Conversely, the optical sensor may be constructed to move in interlocked relation to the plunger 12 (movable member), while the density pattern, i.e. optical pattern, may be fixed in position. Namely, it is only necessary that the optical pattern be displaced, relative to the optical sensor, together with the plunger 12 (movable member).

What is claimed is:

1. An actuator unit for a performance operator member comprising:

a performance operator drive device including a plunger that mechanically drives the performance operator member;

an optical density pattern provided on said plunger and having a pattern where a density gradually varies along a moving direction of said plunger so that an amount of light reflection or light transmission gradually varies in accordance with movement of said plunger, said optical density pattern being provided on a side surface of the plunger and located in a space between the side surface and a casing of the plunger;

an optical sensor that irradiates light toward said optical density pattern and receives light reflected from or transmitted through said optical density pattern, and a velocity detector that detects a moving velocity of said plunger, and wherein said velocity detector is constructed separately from said optical sensor, said velocity detector being also constructed to acquire velocity information directly without acquiring position information, wherein one of said optical density pattern and said optical sensor is provided to move in interlocked relation to said plunger, and the amount of the reflected light or transmitted light, based on said optical density pattern, is detected by said optical sensor, so that a moving position of said plunger is detected on the basis of the detected amount of the reflected light or transmitted light, and wherein said optical density pattern is provided on a detected member that is mounted on said plunger, and said optical density pattern moves together with said plunger, wherein said optical sensor is fixedly provided in a predetermined position, wherein said velocity detector includes a sensor section fixedly provided in a predetermined position, and said sensor section provides an output corresponding to the moving velocity of said plunger, and wherein said optical sensor and said sensor section of said velocity detector are provided as a unit in predetermined positional arrangement.

2. An actuator unit as claimed in claim 1 wherein said optical density pattern is provided on a detected member that is mounted on said plunger, and said optical density pattern moves together with said plunger.

3. An actuator unit as claimed in claim 1 wherein said performance operator drive device automatically operates the performance operator member in response to driving of said plunger.

4. An actuator unit as claimed in claim 1 wherein said performance operator drive device drives said plunger so as to impart a sense of force to operation of the performance operator member.

5. An actuator unit as claimed in claim 1 wherein the performance operator member is a key of a keyboard musical instrument.

6. An actuator unit as claimed in claim 1 wherein said optical sensor is fixedly provided on a casing member of said performance operator drive device.

7. An actuator unit as claimed in claim 6 wherein said casing member has an opening and said optical sensor is disposed in said opening.

8. An actuator unit as claimed in claim 1 wherein said optical density pattern is provided so as to move in a parallel fashion relative to said optical sensor.

* * * * *